US005628263A

United States Patent [19]

Tajima et al.

[11] Patent Number: 5,628,263

[45] Date of Patent: May 13, 1997

[54] CHAIN STITCH SEWING MACHINE WITH LOOPER DRIVE AND LOCK ARRANGEMENT

[75] Inventors: Ikuo Tajima; Satoru Suzuki; Yoichi Mizuguchi, all of Kasugai, Japan

[73] Assignee: Tokai Industrial Sewing Machine Co., Ltd., Aichi, Japan

[21] Appl. No.: 563,608

[22] Filed: Nov. 28, 1995

[30] Foreign Application Priority Data

Dec. 6, 1994 [JP] Japan ..... 6-330553

[51] Int. Cl.[6] ..... D05C 15/22; D05B 57/04

[52] U.S. Cl. ..... 112/98; 112/184; 112/202

[58] Field of Search ..... 112/100, 98, 197, 112/163, 166, 475.18, 202, 201, 470.16, 470.06, 184

[56] References Cited

U.S. PATENT DOCUMENTS

| | | | |
|---|---|---|---|
| 4,373,458 | 2/1983 | Dorosz et al. | 112/470.06 |
| 4,606,285 | 8/1986 | Tajima | 112/98 |
| 5,249,536 | 10/1993 | Hattori et al. | 112/98 |

FOREIGN PATENT DOCUMENTS

| | | |
|---|---|---|
| 61-27075 | 6/1986 | Japan . |
| 1-53385 | 11/1989 | Japan . |
| 5-239757 | 9/1993 | Japan . |
| 6-248560 | 9/1994 | Japan . |

*Primary Examiner*—Ismael Izaguirre
*Attorney, Agent, or Firm*—Koda and Androlia

[57] ABSTRACT

In a chain stitch sewing machine which performs a required chain stitch sewing with respect to a cloth to be processed, by cooperation of a needle reciprocable up and down and a looper arranged under a needle plate, the chain stitch sewing machine comprises: (1) a large diameter drive gear rotatably provided in a base, (2) a looper support supported by the base so that it can slide in a lateral direction, (3) two or more loopers arranged on the looper support at intervals of a predetermined pitch along the lateral direction and freely rotatable on their own axes, (4) small diameter driven gears respectively provided in the two or more loopers and each engageable with the drive gear, and (5) a lock mechanism for non-rotatably locking the two or more loopers at a required timing. When all loopers are non-rotatably locked by the lock mechanism, the driven gears provided in the loopers will form a rack, and if the drive gear (serving as a pinion) is rotated and engaged by the driven gears forming the rack, the driven gears as a whole will be slid in a lateral direction. With this rack and pinion mechanism, a desired looper is selected. In addition, if the locking of the selected looper, positioned in a facing relationship with the drive gear by the looper selecting operation, is released and the drive gear is rotated, the rotation of the selected looper will be controlled.

4 Claims, 6 Drawing Sheets

CHAIN STITCH SEWING MACHINE WITH LOOPER DRIVE AND LOCK ARRANGEMENT

BACKGROUND OF THE INVENTION

1. Field of the Invention

This invention relates to chain stitch sewing machines, and more particularly to an improvement in a mechanism where, in the chain stitch sewing machine which performs chain stitch sewing by cooperation of a needle that is driven to reciprocate in a vertical direction and a looper that is controlled for rotation in synchronization with the needle, thread changeover can be performed by selecting any desired one of a plurality of loopers.

2. Description of the Related Art

Chain stitch sewing machines, constructed so that thread changeover can be performed by selecting any desired one of a plurality of loopers, are disclosed, for example, in Japanese Patent Publication No. SHO 61-27075, Japanese Patent Publication No. HEI 1-53385, Japanese Unexamined Patent Publication No. HEI 5-239757, and Japanese Unexamined Patent Publication No. HEI 6-248560.

In any of the chain stitch sewing machines disclosed in the aforementioned publications, a drive mechanism for rotating and controlling a looper and a drive mechanism for selecting a desired looper from among a plurality of loopers are individually provided independent of each other. For this reason, the number of parts becomes increased as a whole, so that there is the drawback that a structure becomes complicated and a cost of production is increased.

SUMMARY OF THE INVENTION

This invention has been made in order to overcome the aforementioned drawback inevitably inherent in the conventional chain stitch sewing machines.

Accordingly, it is an object of the invention to provide an improved chain stitch sewing machine where the selection of a looper and the control of rotation of the looper can be performed with simple structure.

It is another object of the invention to provide an improved chain stitch sewing machine which is capable of decreasing the number of parts and thus reducing a cost of production.

To achieve the above objects, according to the present invention, there is provided a chain stitch sewing machine designed to perform a predetermined chain stitch sewing on a cloth to be processed by cooperation of a needle that is driven to reciprocate in a vertical direction and a looper disposed below a needle plate, characterized in that the sewing machine is provided with a large diameter drive gear rotatably provided in a base, a looper support supported by the base so that it can slide in a lateral direction, two or more loopers arranged on the looper support at intervals of a predetermined pitch along the lateral direction and freely rotatable on their own axes, small diameter driven gears respectively provided in the two or more loopers and each engageable with the drive gear, and a lock mechanism for non-rotatably locking the two or more loopers at a required timing.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

Figure 6:
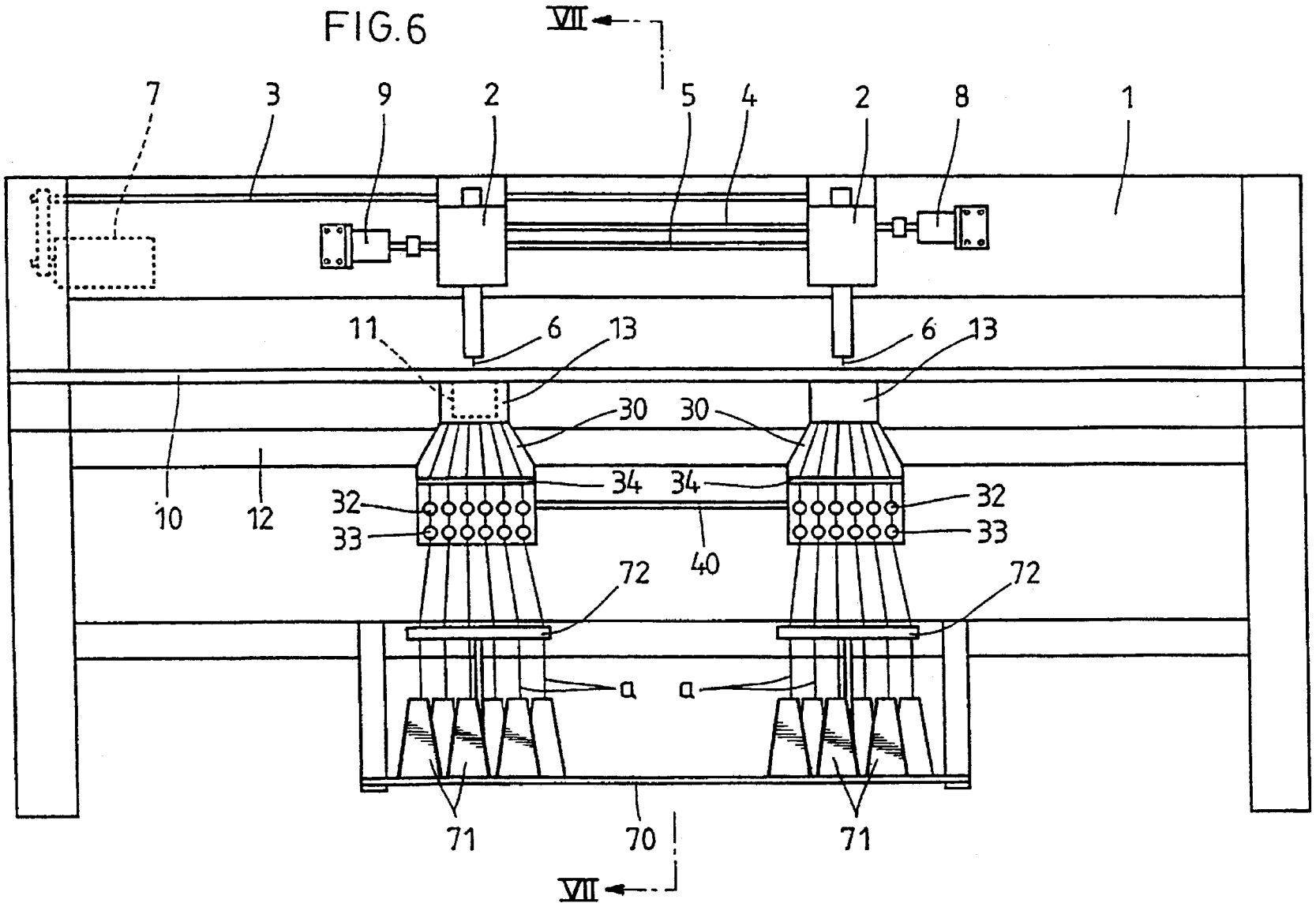
FIG. 6 is a front elevational view showing the chain stitch sewing machine of the present invention.

Referring now in greater detail to the drawings, there is shown a preferred embodiment of a two-head chain stitch sewing machine constructed in accordance with the present invention. In FIG. 6, reference numerals 2 denote two machine heads arranged in front of an upper frame 1 at a predetermined space. A machine main shaft 3 is horizontally provided and connected to the respective machine heads 2 so that needles 6 are reciprocated in a vertical direction by rotation of the main shaft 3. Likewise, a needle position control shaft 4 and a direction control shaft 5 are horizontally provided and connected to the respective machine heads 2 so that the stroke heights of the needles 6 are controlled by rotation of the position control shaft 4 and the directions of the needles 6 are controlled by rotation of the direction control shaft 5. The machine main shaft 3 is driven by a servo motor 7 fixed to the rear face of the left end portion of the upper frame 1. The needle position control shaft 4 and the direction control shaft 5 are driven by pulse motors 8 and 9 fixed to the front surface of the upper frame 1, respectively.

Figure 1:
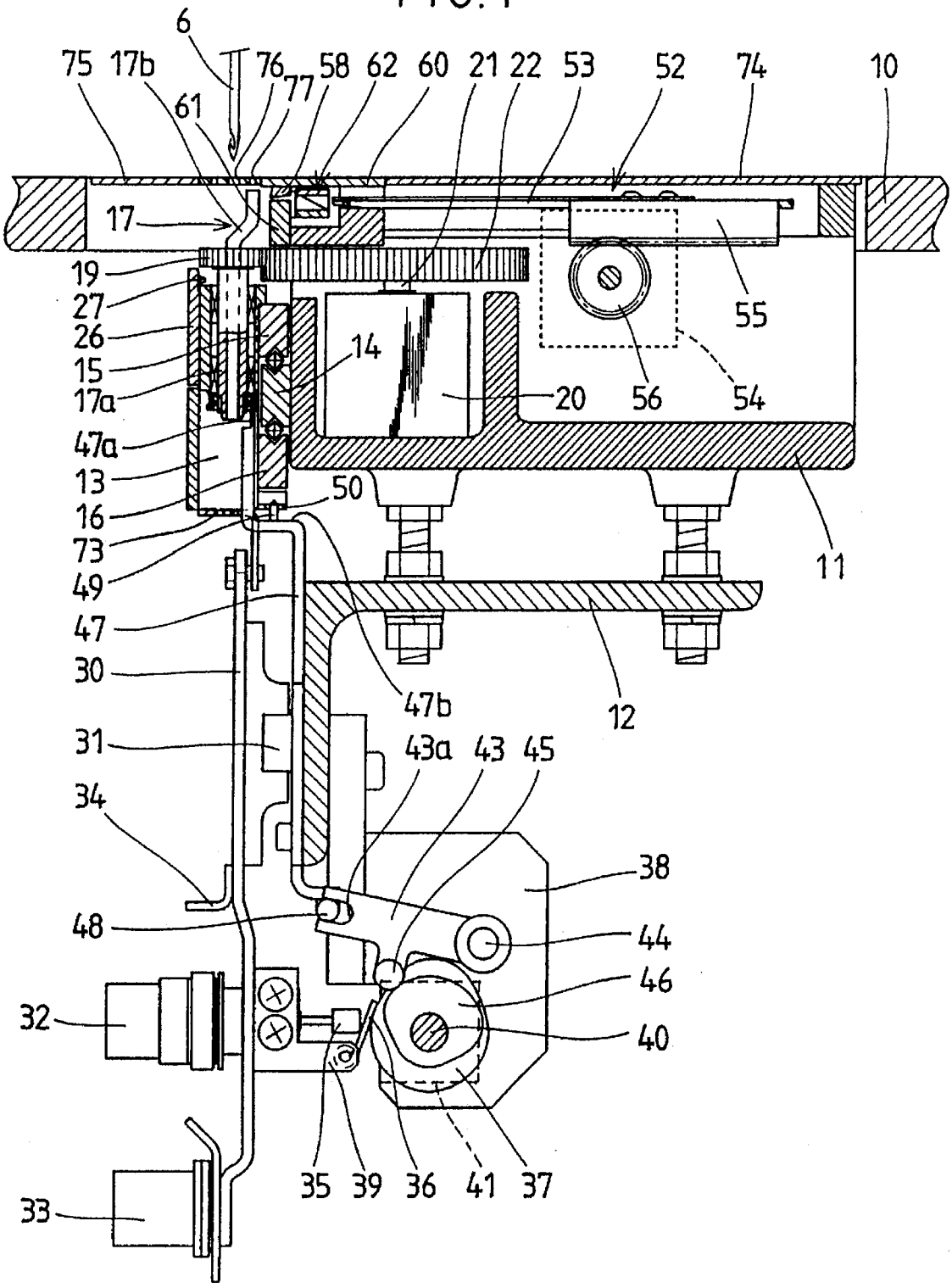
FIG. 1 is a fight-side sectional view showing the looper support and the thread condition base of a chain stitch sewing machine of an embodiment of the present invention.
Figure 7:
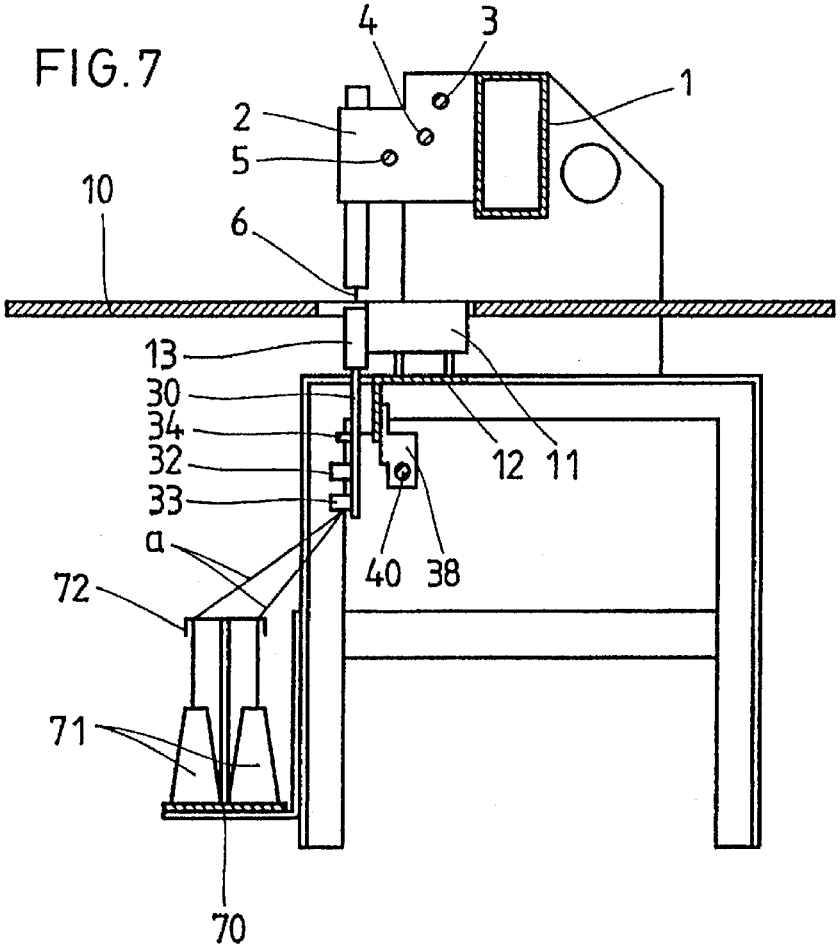
FIG. 7 is a sectional view of the chain stitch sewing machine taken substantially along line VII—VII of FIG. 6.

As shown in FIG. 7, under each machine head 2, a looper base 11 is correspondingly arranged. Specifically, the looper base 11 is fixedly mounted on a lower frame 12 provided under a machine table 10. In front of the looper base 11 there is disposed a corresponding looper support 13. The looper support 13, as shown in FIG. 1, is provided at the rear surface thereof with upper and lower guide rails 15 and 16 horizontally extending. The guide rafts 15 and 16 of the looper support 13 are slidably mounted on a linear raft 14 horizontally fixed to the front surface of the looper base 11 so that the looper support 13 can freely slide in the left and right directions of FIG. 6 with respect to the looper base 11. Each looper support 13, as clearly shown in FIGS. 2 and 3, has a total of six loopers 17 disposed at required intervals along the sliding direction of the looper support 13, the loopers 17 being freely rotatable on their axes and freely movable up and down over a predetermined length. The respective loopers 17 are elastically biased downward at all times by means of corresponding coil springs 18 mounted on the lower ends of the loopers 17 (see FIG. 3).

Figure 2:
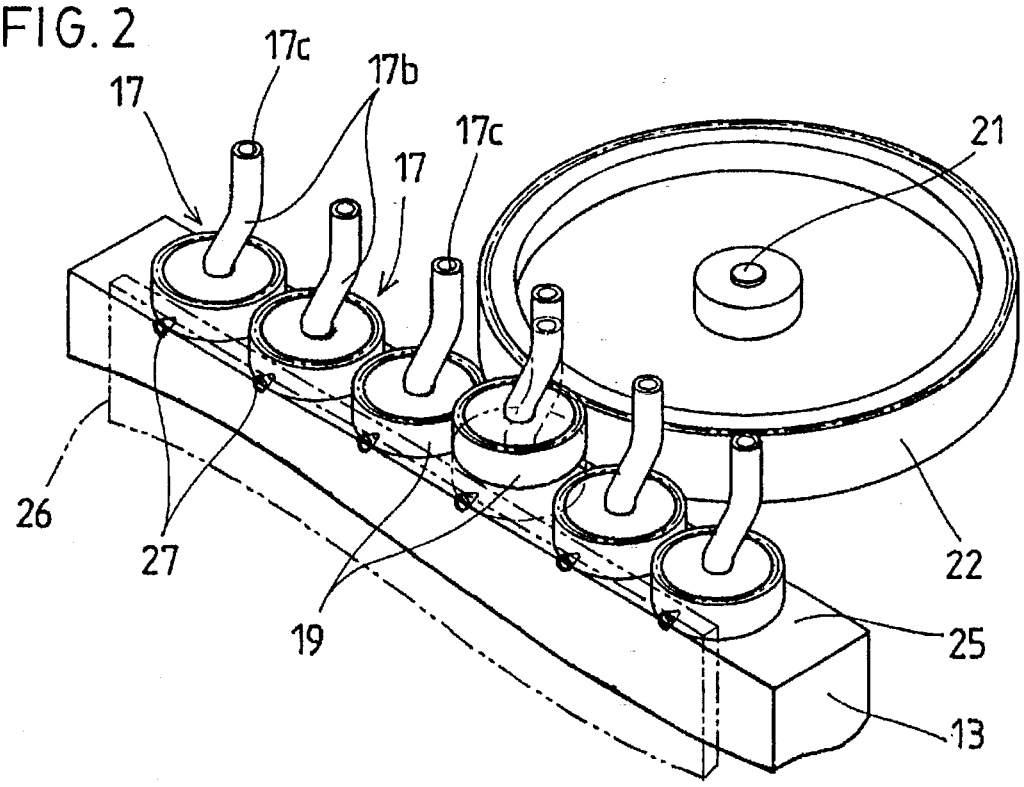
FIG. 2 is a perspective view showing the positional relationship between loopers and a drive gear.
Figure 3:
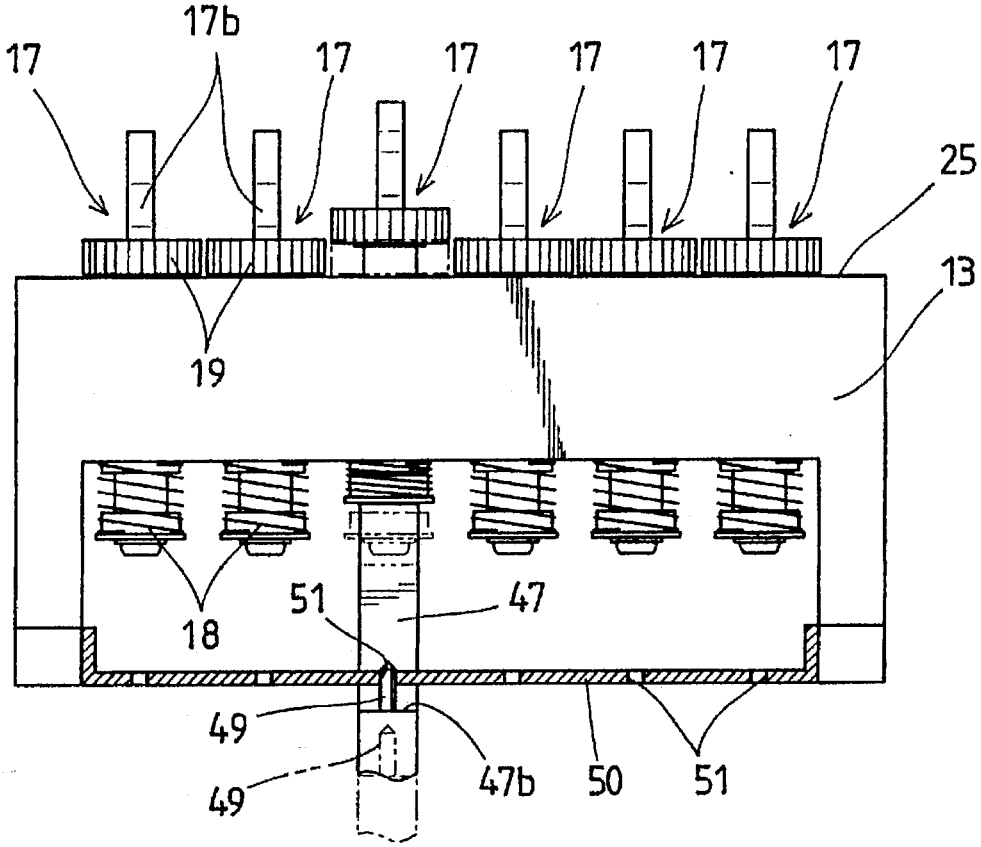
FIG. 3 is a back view showing the looper support of FIG. 1.
Figure 8:
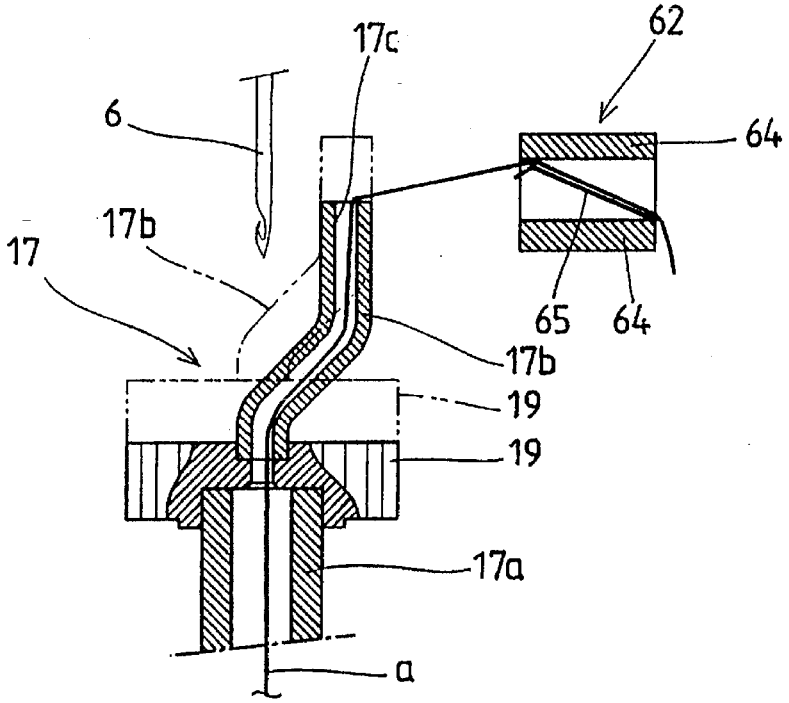
FIG. 8 is an enlarged view showing the positional relationship between the looper and the thread holder.

The looper 17, as seen from FIG. 8, includes a vertically arranged, hollow shaft 17*a*, a spur gear-shaped, driven gear 19 mounted on the upper end portion of the hollow shaft 17*a*, and a crank-shaped thread conductor 17*b* formed with a hollow pipe fixedly mounted in the central portion of the upper surface of the driven gear 19. The hollow shaft 17*a* and the thread conductor 17*b* are connected with each other through the center hole of the driven gear 19, and the upper open portion of the thread conductor 17*b* serves as a thread conduction outlet 17*c*. The driven gear 19, as shown in FIGS. 2 and 3, is elastically urged downward at all times by means of the aforementioned coil spring 18 and is brought into contact with an upper face 25 of the looper support 13. In this state, the gear groove of the driven gear 19 engages with a positioning pin 27 projecting from a front plate 26 of the looper support 13 so that the looper 17 is non-rotatably positioned and also the thread conduction outlet 17*c* is directed into its rearmost position.

On the front portion of each looper base 11, as shown in FIG. 1, a pulse motor 20 with a vertical motor shaft 21 is fixedly mounted, and a drive gear 22 comprising a spur gear fixedly mounted on the upper end of the vertical motor shaft 21 is engageable with the driven gear 19 of the looper 17 positioned in a facing relationship with the drive gear 22. The diameter of the drive gear 22 is set so that it becomes about 4 times greater than the diameter of the driven gear 19. Therefore, even when the driven gear 19 is in its upper position indicated by a solid line in FIG. 3 or in its lower position indicated by a one-dot chain line, the driven gear 19 is engageable with the corresponding drive gear 22. Also, when all loopers 17 are in the lower positions indicated by solid lines in FIG. 3 and also all the driven gears 19 of the loopers 17 are non-rotatably locked by the aforementioned positioning pins 27, the driven gears 19 as a whole form a gear train such as the teeth of a rack arranged in a lateral direction. As previously described, the looper support 13 having the driven gears 19 supported thereon is laterally slidable with respect to the looper base 11. Thus, if the aforementioned drive gear 22 is rotated on its axis in this state, the drive gear 22 will serve as a pinion and will sequentially mesh with the driven gear train 19 serving as a rack. As a result, the rotation of the drive gear 22 causes the looper support 13 to laterally slide. Therefore, if, in the state where all loopers 17 are in their lower positions, the drive gear 22 is rotated by the pulse motor, a desired looper 17 can be moved into a position facing the drive gear 22, thereby achieving the selection of the looper.

Figure 4:
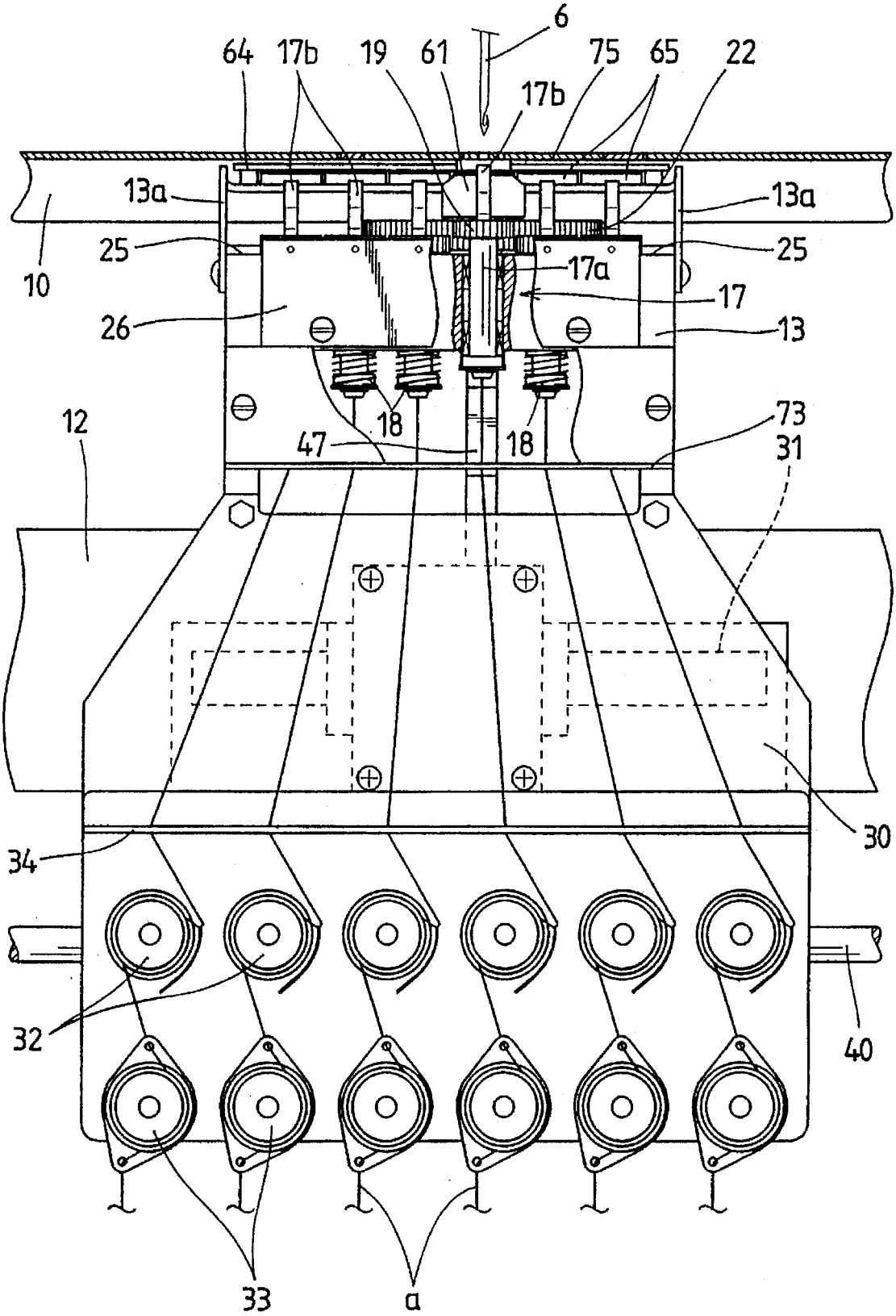
FIG. 4 is an enlarged front view of the looper support and the thread condition base.

As shown in FIGS. 1 and 4, under each of the looper supports 13 there is disposed a thread condition base 30. This thread condition base 30 moves together with the corresponding looper support 13 in selectively manipulating the looper. Each thread condition base 30 is slidably supported by a horizontal linear rail 31 so that it can freely move laterally with respect to the front surface of a lower frame 12. To the front surface of the thread condition base 30, six pairs of a first thread conditioner 32 and a second thread conditioner 33 are attached in correspondence with the aforementioned six loopers 17. Also, there is attached a horizontally extending thread guide 34 to the front central portion of the thread condition base 30.

The first thread conditioner 32, as shown in FIG. 1, is constructed so that application of tension force to a sewing thread (not shown) is released by pushing in a regulation pin 35 from the rear end thereof and also the application of tension force is performed by pulling out the regulation pin 35.

The regulation pin 35 is always urged to a direction of projection by means of the elastic force of a spring (not shown). To push in the six regulation pins 35 corresponding to 6 first thread conditioners 32 at the same time, a horizontally extending press plate 36 is provided on the back side of the thread condition base 30. The press plate 36 is pivotably supported at its lower end by a support member 39 fixed to the back surface of the thread condition base 30, and the press plate 36 is pivoted by means of a first plate cam 37 provided rearward of the press plate 36.

The first plate cam 37, as shown in FIGS. 1 and 7, is fixedly mounted on a rotational shaft 40, supported rearward of each thread condition plate 30 and supported by a plurality of brackets 38 fixed to the lower frame 12. The rotational shaft 40 is connected to a pulse motor 41 fixed to one bracket 38. On the bracket 38, as shown in FIG. 1, a pivot arm 43 is pivotably supported by means of a pin 44. This pivot arm 43 is pivoted by the operation of engagement between a cam follower 45 pivotably provided in the longitudinal central portion thereof and a second plate cam 46 fixed to the rotational shaft 40. Also, the pivot arm 43 has at its free end a bifurcated portion 43*a* which is engaged by the lower end of a drive lever 47 for moving the looper 17 upward. That is, the drive lever 47 is supported so that it can move up and down on the front surface of the lower frame 12. The drive lever 47 has at its upper end a push-up portion 47*a* contacting the lower end of the looper 17, and a pin 48 projecting from the lower end portion of the drive lever 47 is fitted into the bifurcated portion 43*a* of the aforementioned pivot arm 43. The pivot arm 43 is urged in a counterclockwise direction of FIG. 1 so that the drive lever 47 is urged downward and also the cam follower 45 is always pushed against the second plate cam 46.

As shown in FIG. 1, the drive lever 47 for moving the looper 17 upward is formed into a crank shape, and from a horizontal portion 47*b* thereof a stopper pin 49 (FIG. 3) projects vertically and upward. In a bridge plate 50 horizontally extending between the opposite lower ends of the looper support 13, a plurality of fit holes 51 into which the stopper pin 49 is fitted are formed at predetermined intervals in correspondence with the lower ends of the six loopers 17. And, when the looper 17, positioned in an opposed relationship with the aforementioned drive gear 22 by the looper selecting operation, is moved to the upper position by the aforementioned drive lever 47, then the driven gear 19 of the looper 17 will be disengaged from the positioning pin 27 and at the same time the stopper pin 49 of the drive lever 47 will be fitted into the fit hole 51 corresponding to the selected looper 17. With this arrangement, the looper support 13 is locked to the state where it cannot slide, and the selected looper 17 goes to the state where it can be rotated by rotation of the drive gear 22.

Figure 5:
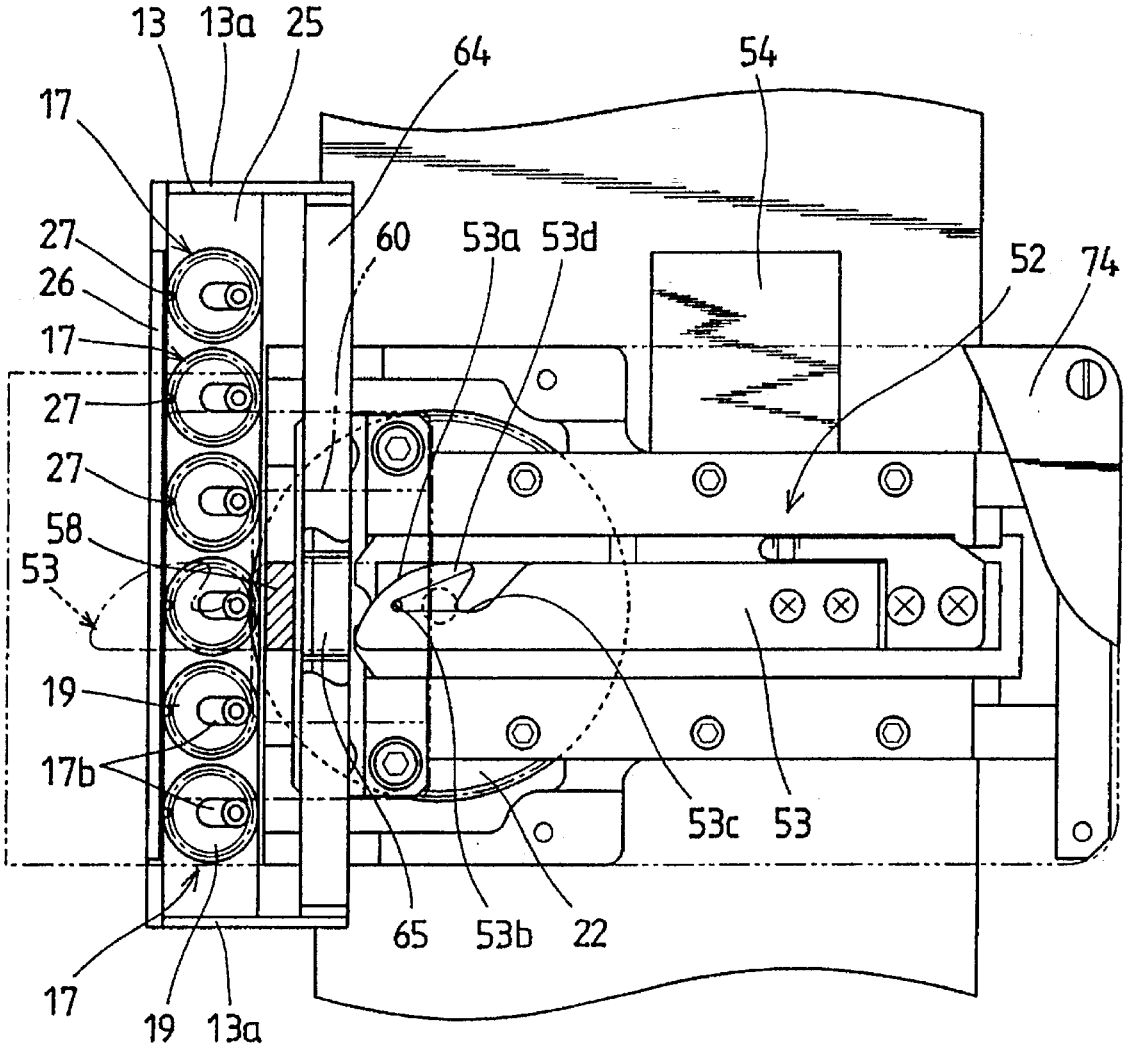
FIG. 5 is a plan view showing the relationship between the looper support and the thread cutting mechanism.

As shown in FIGS. 1 and 5, a thread cutting mechanism generally designated by reference numeral 52 is provided above each looper base 11. This thread cutting mechanism 52 is constructed so that a movable knife 53, movably supported in the longitudinal direction, is driven by a pulse motor 54 fixed to the outer surface of the looper base 11. To the under surface of the movable knife 53 there is fixed a rack 55 which is engaged by a drive gear 56 fixedly mounted on the motor shaft of the pulse motor 54. The front end portion of the movable knife 53 is formed with a thread induction portion 53*a*, a circular arc-shaped blade portion 53*b*, a thread capture portion 53*c*, and a thread drop portion 53*d* extending between the thread capture portion 53*c* and the blade portion 53*b*. When the movable knife 53 is in its stand-by position indicated by a solid line in FIG. 5, the front end thereof is retracted into a position rearwardly away from the looper 17. As shown in FIG. 1, a stationary knife 58 is provided rearward of the selected looper 17 (in a facing relationship with the drive gear 22). This stationary knife 58 is fixedly mounted on the under surface of the front portion of a support 60 fixedly mounted on the upper surface of the looper base 11, and the lower edge of the front end thereof is formed as a cut portion. Under the stationary knife 58 there is provided a support block 61, and between the upper surface of the block 61 and the under surface of the stationary knife 58 there is secured a gap which allows the passing-through of the front end portion of the movable knife 53.

A space for accommodating thread holders 62 is formed rearward of the stationary knife 58. The thread holders 62 comprise 6 thread holders in total. Each thread holder 62, as shown in FIGS. 4 and 8, is constituted by a pair of upper and lower support plates 64 and 64 extending between brackets fixed to the opposite ends of the looper support 13 and a hold plate 65 arranged between the upper and lower support plates 64 and 64. Each hold plate 65 comprises a folded elastic plate, and the free end thereof elastically contacts the under surface of the upper support plate 64, as shown in FIG. 8. The holder plate 65 moves together with the looper support 13 at the time of the selection of a looper, and the hold plate 65 corresponding to the selected looper 17 is positioned in a facing relationship with the rear end of the stationary knife 58.

As shown in FIG. 7, under each of the thread condition bases 30 there is disposed a horizontal bobbin mounting plate 70, and on the bobbin plate 70 there are mounted 6 pairs of bobbins 71 for supplying threads to the thread condition base 30. A sewing thread a unwound from each of the bobbins 71 passes through a thread guide 72, the first and second thread conditioners 32 and 33 of the thread condition base 30, the thread guide 34, and the thread guide 73 of the looper support 13, and then is conducted into the corresponding looper 17. Incidentally, as shown in FIG. 1, the upper surface of the looper base 11 and the upper portion of the looper support 13 are closed with a cover plate 74. Also, a needle plate 75 is provided in a place which is located just above a selected looper 17. The needle plate 75 is formed with a needle drop hole 76 through which a needle 6 passes and thread holes 77 arranged around the needle drop hole 76.

Operation of the Invention

Now, the operation of the chain stitch sewing machine according to the embodiment of the present invention will be described.

Assume, for example, that different sewing threads different in color have been set to the loopers 17 of the looper support 13 and, as shown in FIG. 8, each sewing thread a, conducted from the thread conduction outlet 17*c*, has been held by the hold plate 65. In starting sewing, initially the selection of a sewing thread a (looper 17) is performed. At the time of this looper selection, the aforementioned pulse motor 41 is driven by an instruction manually input from a manipulation panel or an automatic instruction based on a program. The rotation of the pulse motor 41 causes the first and second plate cams 37 and 46 to rotate. Then, the press plate 36 corresponds to the position of the minimum diameter of the first plate cam 37 and the cam follower 45 of the pivot arm 43 corresponds to the position of the minimum diameter of the second plate cam 46. As a result, the regulation pin 35 of each of the second thread conditioners 32 projects, and the second thread conditioners 32 assume the state where tension forces are applied to all sewing threads a. Also, the free end of the pivot arm 43 reaches its lowest position and the drive lever 47 reaches its lower position, so that the push-up portion 47*a* of the drive lever 47 goes to a state spaced from the lower end of the looper 17. At the same time, the stopper pin 49 is disengaged from the fit hole 51 and the looper support 13 assumes the slidable state. Furthermore, the loopers 17 of the looper support 13 are all in their lower positions, and each looper 17 assumes the rotation impossible state by the engagement between the driven gear 19 and the positioning pin 27. After this state, the pulse motor 20 is driven by an instruction manually input from a manipulation panel or an automatic instruction based on a program. With the engagement between the drive gear 22 and the driven gears 19, the looper support 13 is slid and a desired looper 17 is selected.

After the looper selecting operation, the rotational shaft 40 connected to the pulse motor 41 is rotated at the time the driven gear 19 of the selected looper 17 has faced the drive gear 22. As a result, the cam follower 45 of the pivot arm 43 corresponds to the position of the maximum diameter of the second plate cam 46. With this movement, the pivot arm 43 is rotated in the clockwise direction, the drive lever 47 is moved up to the upper position, and the lower end of the looper 17 in the selected position is pushed up by the push-up portion 47*a*. Therefore, the driven gear 19 of the selected looper 17 is disengaged from the positioning pin 27, and as shown by a solid line in FIG. 3, the stopper pin 49 of the drive lever 47 is fitted into the fit hole 51 and the looper support 13 is locked to the slide impossible state. In the state shown in FIG. 4, the third looper 17 from the fight of the looper support 13 is selected and the driven gear 19 of the third looper 17 is brought into engagement with the drive gear 22.

Thereafter, if a start switch is turned on, the main shaft motor 7 will be driven and the machine main shaft 3 will be rotated. With the rotation of the main shaft 3, the needle 6 is driven to move up and down and each pulse motor 20 is driven in synchronization with the motion of the needle 6. As a result, the rotation of the looper 17 is controlled and a required chain stitch sewing is performed. When the sewing using the selected thread a (looper 17) is completed, the looper 17 will be lowered to the lower position. Specifically, the rotation of the pulse motor 41 causes the rotational shaft 40 to rotate. With the rotation of the shaft 40, the drive lever 47 is lowered, and consequently, the looper 17 in the upper position is lowered to the lower position.

Subsequently, the pulse motor 54 of the thread cutting mechanism 52 is driven and the movable knife 53 in the solid line position shown in FIG. 5 is moved left. At the time the movable knife 53 has reached the most projected position indicated by a two-dot chain line in FIG. 5, the pulse motor 57 is rotated in the opposite direction and the movable knife 53 returns to the stand-by position. During the process, the cutting of the sewing thread a and the hold operation of the thread end are performed. More specifically, the sewing thread a, tensioned between the needle drop hole 76 of the needle plate 75 and the thread conduction outlet 17*c* of the looper 17, is engaged by the thread induction portion 53*a* of the movable knife 53 passing through the gap between the stationary knife 58 and the support block 61 and advancing toward the sewing thread and is pushed once outward. At the time the movable knife 53 has reached the most projected position, the sewing thread a is induced by the thread induction portion 53*a* and captured by the thread capture portion 53*c* of the movable knife 53. Thereafter, as the movable knife 53 is retracted toward the stand-by position, the sewing thread a is pulled toward the stationary knife 58 by the thread capture portion 53*c*, and consequently, the sewing thread a is cut by the blade portion 53*d* and the stationary knife 53. In cutting, the movable knife 53 is subjected to a downward bending force, but since it is prevented from being bent downward by the support block 61, reliable cutting is achieved. When the movable knife 53 cuts the sewing thread a in cooperation with the stationary knife 58 and then is further retracted, the thread end is dropped from the gap between the thread drop portion 53*d* and the lower end of the stationary knife 58. At the time the movable knife 53 has returned to the stand-by position, the sewing thread a on the looper 17 side is held between the hold plate 65 and the upper support plate 64 by means of the elastic force of the hold plate 65, as shown in FIG. 8.

After the above operation, the selection of another looper 17 is again started by the sliding motion of the looper support 13, and multi color sewing of different color threads (loopers 17) can be performed by repeating the aforementioned sequence of operations until a thread is cut. After the selection operation of the looper 17, it is moved to the upper position of FIG. 1 by the rotation of the rotational shaft 40, and then if the rotational shaft 40 is further rotated, the position of the maximum diameter of the first plate cam 37 will cause the press plate 36 to rotate. The rotation of the press plate 36 causes the regulation pin 35 to be pushed into the first thread conditioner 32, and consequently, application of tension force to a sewing thread a is released. Therefore, the application of tension force to a sewing thread a can be controlled and selected by whether the rotational shaft 40 is further rotated after the looper 17 is moved to the upper position by rotation of the rotational shaft 40, and an appropriate thread conditioner can be thus obtained with respect to loop sewing and chain sewing.

While the embodiment of the present invention has been illustrated and described with reference to a multi head chain stitch sewing machine with two machine heads, the invention may be applied to a single head chain stitch sewing machine. Also, while a plurality of pulse motors have been provided in the looper base for directly rotating drive gears, each motor shaft may be connected to a common drive shaft supported by the looper base and each motor may be driven through intermediate gears fixed to the common drive shaft. In addition, although the lock mechanism of the loopers has been constituted by loopers movable up and down and positioning pins engageable with the loopers in the lower positions, the lock mechanism may be formed with other structures. For example, the lock mechanism may be constructed so that loopers can be individually locked and unlocked without moving the loopers up and down.

Therefore, the present embodiment is to be considered as illustrative and not restrictive and the invention is not to be limited to the details given herein, but may be modified within the scope of the appended claims.

What is claimed is:

1. A chain stitch sewing machine which performs a required chain stitch sewing with respect to a cloth to be processed, by cooperation of a needle reciprocable up and down and a looper arranged under a needle plate, the chain stitch sewing machine comprising:

a large diameter drive gear rotatably provided in a base;

a looper support slidably supported by said base so that it is slidable in a lateral direction;

two or more loopers arranged on said looper support at intervals of a predetermined pitch along a lateral direction and freely rotatable on their own axes;

small diameter driven gears respectively provided in said two or more loopers and each engageable with said drive gear; and a lock mechanism for non-rotatably locking said two or more loopers at a required timing; and wherein, with the state where said driven gears has been aligned on the said looper support and all of said two or more loopers have been non-rotatably locked, said drive gear is rotated so that said two or more loopers engage with said drive gear in sequence and also said looper support is slid in said lateral direction with respect to said base, thereby selecting a desired one of said two or more loopers.

2. The chain stitch sewing machine according to claim 1, wherein said drive gear is driven by a motor fixedly mounted on said base.

3. The chain stitch sewing machine according to claim 1, wherein each of said two or more loopers are movably supported by said looper support so that each of said two or more loopers is movable up and down, and when one of said two or more loopers is positioned in its lower position, the driven gear provided in the positioned looper and a positioning pin arranged adjacent said looper support are engaged with each other, thereby non-rotatably locking said positioned looper.

4. A chain stitch sewing machine according to claim 1, wherein, after selecting said one of said two or more loopers, said selected looper is moved up so that a lock of said looper caused by said locking mechanism is released.

* * * * *